US010036302B2

(12) United States Patent
Watanabe

(10) Patent No.: US 10,036,302 B2
(45) Date of Patent: Jul. 31, 2018

(54) COOLING DEVICE FOR INTERNAL COMBUSTION ENGINE

(71) Applicant: TOYOTA JIDOSHA KABUSHIKI KAISHA, Toyota-shi, Aichi-ken (JP)

(72) Inventor: Hiroshi Watanabe, Shizuoka-ken (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/220,879

(22) Filed: Jul. 27, 2016

(65) Prior Publication Data

US 2017/0030251 A1 Feb. 2, 2017

(30) Foreign Application Priority Data

Jul. 29, 2015 (JP) ..... 2015-149494

(51) Int. Cl.

| | |
|---|---|
| ***F01P 7/14*** | (2006.01) |
| ***F01P 7/16*** | (2006.01) |
| ***F02D 41/04*** | (2006.01) |
| ***F01P 3/20*** | (2006.01) |
| ***F01P 5/12*** | (2006.01) |

(52) U.S. Cl.

CPC ..... *F01P 7/165* (2013.01); *F01P 3/20* (2013.01); *F01P 5/12* (2013.01); *F02D 41/04* (2013.01); *F01P 2007/146* (2013.01); *F01P 2031/00* (2013.01); *F01P 2037/00* (2013.01); *F01P 2060/08* (2013.01); *F02D 2250/26* (2013.01)

(58) Field of Classification Search

CPC ..... F01P 7/167; F01P 7/165

USPC ..... 123/41.08, 41.1; 137/625.46

See application file for complete search history.

(56) References Cited

U.S. PATENT DOCUMENTS 5,529,026 A * 6/1996 Kurr ..... B60H 1/00485 123/41.1
5,626,117 A * 5/1997 Wright ..... F02D 41/0255 123/406.55
6,164,248 A * 12/2000 Lehmann ..... F01P 5/10 123/41.1
6,523,525 B1 2/2003 Hawkins (Continued)

FOREIGN PATENT DOCUMENTS

JP H10-131753 A 5/1998
JP 2002-106347 A 4/2002

(Continued)

*Primary Examiner* — Marguerite McMahon
*Assistant Examiner* — James Kim
(74) *Attorney, Agent, or Firm* — Hunton Andrews Kurth LLP

(57) ABSTRACT

A cooling device includes a first cooling medium circuit for circulating a cooling medium that passes through a main body of an engine to a first heat exchanger, a second cooling medium circuit for circulating a cooling medium that passes through the main body to a second heat exchanger, a control valve that is commonly used in the first and second cooling medium circuits, and a control device. The control valve includes a rotatable rotor, and is configured such that a rotation range of the rotor includes a water stop section in which the circuits are both closed. The control device restricts output power of the engine in a period in which the rotation angle is in the water stop section, when the rotor rotates via the water stop section at an operating time of the control valve.

3 Claims, 5 Drawing Sheets

(56) References Cited

U.S. PATENT DOCUMENTS

| | | | | |
|---|---|---|---|---|
| 6,539,899 | B1 * | 4/2003 | Piccirilli | F01P 7/167 123/41.08 |
| 6,745,995 | B2 * | 6/2004 | Hu | F01P 7/167 123/41.08 |
| 6,819,996 | B2 * | 11/2004 | Graves | B60W 10/04 123/352 |
| 6,920,845 | B2 * | 7/2005 | Lelkes | F01P 7/167 123/41.01 |
| 6,938,586 | B2 * | 9/2005 | Manners | F01P 7/16 123/41.1 |
| 7,165,513 | B2 * | 1/2007 | Humburg | B60H 1/00485 123/41.08 |
| 7,506,664 | B2 * | 3/2009 | Norris | B60H 1/00485 137/625.17 |
| 8,347,831 | B2 * | 1/2013 | Vacca | F16K 11/085 123/41.08 |
| 9,032,915 | B2 * | 5/2015 | Tobergte | F01P 3/02 123/41.01 |
| 9,145,821 | B2 * | 9/2015 | Lee | F01P 7/14 |
| 2004/0173167 | A1 | 9/2004 | Chanfreau et al. | |
| 2011/0073066 | A1 * | 3/2011 | Sotani | B60K 11/02 123/198 E |
| 2014/0190427 | A1 | 7/2014 | Nagahama et al. | |

FOREIGN PATENT DOCUMENTS

| | | | |
|---|---|---|---|
| JP | 2004-534177 | A | 11/2004 |
| JP | 2013-068162 | A | 4/2013 |
| JP | 2013-234605 | A | 11/2013 |
| JP | 2014-070592 | A | 4/2014 |

* cited by examiner

COOLING DEVICE FOR INTERNAL COMBUSTION ENGINE

CROSS-REFERENCE TO RELATED APPLICATION

The present application claims priority to Japanese Patent Application No. 2015-149494 filed on Jul. 29, 2015, which is incorporated herein by reference in its entirety.

TECHNICAL FIELD

Embodiments of the present invention relate to a cooling device for an internal combustion engine.

BACKGROUND

For example, Japanese Patent Laid-Open No. 10-131753 discloses a cooling device including a cooling medium circuit in which a cooling medium that is caused to pass through both an engine and a radiator flows, a bypass channel that bypasses the radiator halfway in the cooling medium circuit, and a flow control valve that is provided in the bypass channel. In this device, the flow control valve is configured by a valve housing, and a rotary type rotor that is rotatably installed in the valve housing. By rotating the rotor, opening and closing states of the cooling medium circuit and the bypass channel can be controlled.

Further, Japanese Patent Laid-Open No. 2013-234605 discloses an engine cooling system that causes a cooling medium that passes through the main body of the engine to pass through three cooling medium circuits by an electronic control valve and return to the engine. The system specifically includes a first cooling medium circuit that is provided with a radiator, a second cooling medium circuit that is provided with a heater, and a third cooling medium circuit that is provided with an oil cooler, and the electronic control valve includes three branch valves that open and close the respective cooling medium circuits. In this system, opening degrees of the respective branch valves are controlled independently, and therefore, flow rates of the cooling medium to be caused to flow into the respective cooling medium circuits can be controlled individually.

LIST OF RELATED ART

Following is a list of patent literatures which the applicant has noticed as related arts of embodiments of the present invention.

[Patent Literature 1]

Japanese Patent Laid-Open No. 10-131753

[Patent Literature 2]

Japanese Patent Laid-Open No. 2013-234605

SUMMARY

Incidentally, if the electronic control valve in Japanese Patent Laid-Open No. 2013-234605 described above is configured by the flow control valve in Japanese Patent Laid-Open No. 10-131753 described above, an installation space for the control valve can be saved. Further, if the above described flow control valve is provided in the installation site of the above described electronic control valve, the opening and closing states of the respective cooling medium circuits can be controlled by the rotation of the above described rotor. Consequently, the cooling medium is caused to flow to the oil cooler by opening the above described third cooling medium circuit at the time of startup of the engine, for example, whereby the oil temperature is increased and fuel efficiency can be enhanced. Further, at the time of a heater request, the cooling medium is caused to pass through the heater by opening the above described second cooling medium circuit, and an in-vehicle air temperature can be also increased.

However, if the opening and closing states of a plurality of cooling medium circuits are switched by rotating the above described rotor, a water stop time period may occur, in which circulation of the cooling medium to the internal combustion engine is stopped by all of the cooling medium circuits being closed, due to the structure of the above described rotor. If the heat generation amount of the internal combustion engine is increased during the water stop time period, the cooling medium is likely to be boiled without being cooled.

Embodiments of the present invention address the problem described above, and has an object to provide a cooling device for an internal combustion engine that can avoid boiling of a cooling medium that accompanies closure of all cooling medium circuits, in the internal combustion engine which controls opening and closing states of a plurality of cooling medium circuits by a control valve including a rotor.

In accomplishing the above objective, according to a first embodiment of the present invention, there is provided a cooling device for an internal combustion engine, comprising:

a first cooling medium circuit for returning a cooling medium that passes through a main body of the internal combustion engine to the main body after causing the cooling medium to flow through a first heat exchanger;

a second cooling medium circuit for returning the cooling medium that passes through the main body to the main body after causing the cooling medium to flow through a second heat exchanger;

a control valve that is commonly used in the first cooling medium circuit and the second cooling medium circuit, includes a rotatable rotor inside the control valve, and is configured such that opening and closing states of the first cooling medium circuit and the second cooling medium circuit respectively change in response to a rotation angle of the rotor from a reference position, in which a rotation range of the rotor includes a water stop section in which the first cooling medium circuit and the second cooling medium circuit are both closed; and a control device that is configured to control an operation of the control valve in accordance with a request to the internal combustion engine, and restrict output power of the internal combustion engine in a period in which the rotation angle of the rotor is in the water stop section, when the rotor rotates via the water stop section at an operating time of the control valve.

According to a second embodiment of the present invention, there is provided a cooling device for an internal combustion engine according to the first embodiment, wherein the second heat exchanger includes a heater core of an air-conditioner, the control valve is configured so that a rotation angle corresponding to the water stop section is interposed, when the rotor is operated from a rotation angle corresponding to a first mode in which the second cooling medium circuit is opened, to a rotation angle corresponding to a second mode in which the first cooling medium circuit is opened and the second cooling medium circuit is closed, and the control device is configured to operate the rotor to the rotation angle corresponding to the first mode when a request to cause the cooling medium to flow through the heater core is present, and operate the rotor to the rotation angle corresponding to the second mode when the request to cause the cooling medium to flow through the heater core is absent.

According to a third embodiment of the present invention, there is provided a cooling device for an internal combustion engine according to the first embodiment, wherein the internal combustion engine includes an automatic transmission, and a mechanical type water pump that is driven by a rotational force of the internal combustion engine, and the control device is configured to restrict speed change to a speed reduction side of the automatic transmission, when the control device restricts the output power of the internal combustion engine in the period in which the rotation angle of the rotor is in the water stop section.

According to a fourth embodiment of the present invention, there is provided a cooling device for an internal combustion engine according to the first embodiment, wherein the control device is configured to control an engine speed and an engine load of the internal combustion engine so that the output power of the internal combustion engine in the period in which the rotation angle of the rotor is in the water stop section does not exceed a predetermined value.

According to the first embodiment of the present invention, the control valve includes the rotatable rotor, and is configured such that the opening and closing states of the first cooling medium circuit and the second cooling medium circuit respectively change in response to the rotation angle of the rotor. The output power of the internal combustion engine in the water stop section is restricted, if the rotor rotates via the water stop section in which the first cooling medium circuit and the second cooling medium circuit are both closed at an operating time of the control valve. Consequently, according to this embodiment, boiling of the cooling medium accompanying closure of all of the cooling medium circuits can be avoided.

According to the second embodiment of the present invention, the rotation angle corresponding to the water stop section is interposed in the process of operating the rotor of the control valve by receiving change of presence or absence of the request to cause the cooling medium to flow to the heater core. According to this embodiment, the output power of the internal combustion engine in the water stop section is restricted, and therefore, even if the operation of the air-conditioner is frequently changed, boiling of the cooling medium can be effectively avoided.

According to the third embodiment of the present invention, speed change to the speed reduction side of the automatic transmission in the period in which the rotation angle of the rotor is in the water stop section is restricted. Consequently, according to this embodiment, increase in the engine speed of the internal combustion engine in the period of the water stop section can be restrained, and therefore, increase in pressure of the cooling medium circuit and the control valve by increase in the rotation of the mechanical type water pump can be restrained.

According to the fourth embodiment of the present invention, if the output power of the internal combustion engine is restricted, the engine speed and the engine load are restricted so that the output power of the internal combustion engine does not exceed the predetermined value. Consequently, according to this embodiment, heat generation of the internal combustion engine can be restrained, and therefore, boiling of the cooling medium can be effectively avoided.

DETAILED DESCRIPTION

Hereinafter, an embodiment of the present invention will be described with reference to the drawings. Note that when the numerals of the numbers, the quantities, the amounts, the ranges of the respective elements are mentioned in the embodiment shown as follows, the present invention is not limited to the mentioned numerals unless specially explicitly described otherwise, or unless the invention is explicitly specified by the numerals theoretically. Further, structures, steps that are described in the embodiment shown as follows are not always indispensable to the present invention unless specially explicitly shown otherwise, or unless the invention is explicitly specified by them theoretically.

Embodiment

An embodiment of the present invention will be described with reference to the drawings.

Configuration of Embodiment

Figure 1:
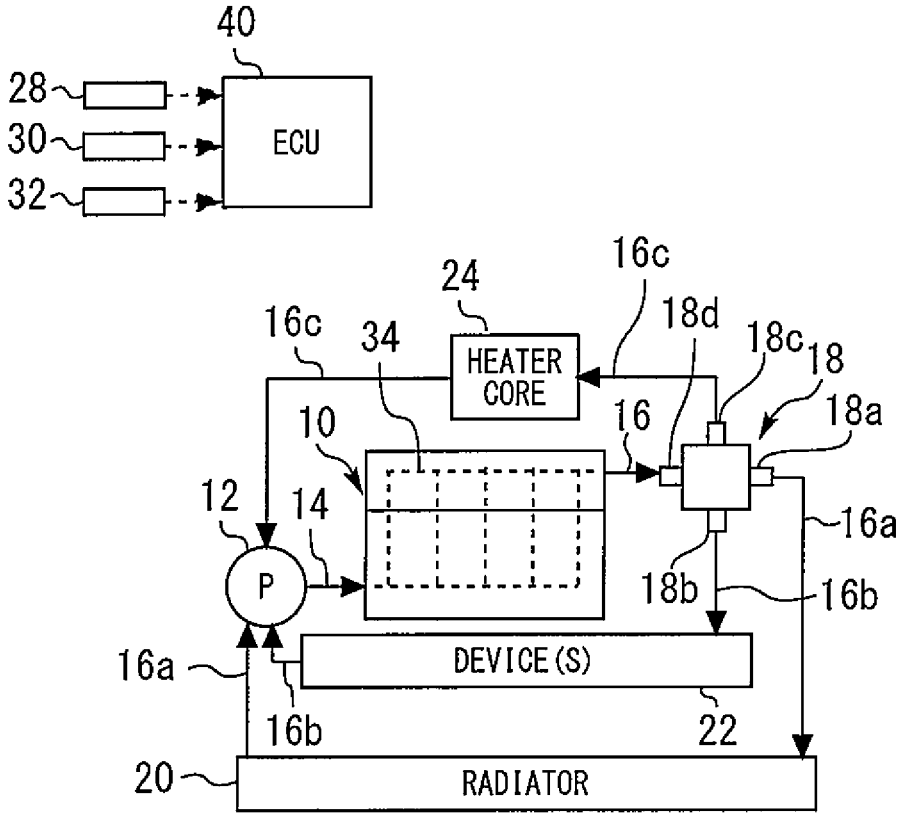
FIG. 1 is a view for explaining a configuration of a cooling device of an embodiment of the present invention.

FIG. 1 is a view for explaining a configuration of a cooling device of an embodiment of the present invention. As shown in FIG. 1, the cooling device of the present embodiment includes an engine 10 as an internal combustion engine that is loaded on a vehicle. In a main body (a cylinder block and a cylinder head) of the internal combustion engine 10, a water jacket 34 is provided. Heat exchange is performed between a cooling medium (engine cooling water) that flows in the water jacket 34 and the engine 10.

The cooling medium which flows in the water jacket 34 is supplied from a mechanical type water pump 12. The water pump 12 includes an impeller (not illustrated) that delivers the cooling medium by rotation, and the impeller is configured to be rotationally driven by a rotational force of the engine 10.

An inlet portion of the water jacket 34 and a discharge port (not illustrated) of the water pump 12 are connected by a supply channel 14. A return channel 16 is connected to an outlet portion of the water jacket 34. The return channel 16 branches into three channels 16*a* to 16*c* halfway. The branch channels 16*a* to 16*c* are independently connected to an intake port (not illustrated) of the water pump 12. That is, the cooling device of the present embodiment includes three cooling medium circulation channels in which the supply channel 14, the water jacket 34 and the return channel 16 are common, and the branch channels 16*a* to 16*c* are independent.

A first circulation channel is a channel that passes the cooling medium through a radiator 20 that is provided in the branch channel 16*a*, and is configured by the supply channel 14, the return channel 16 and the branch channel 16*a*. During circulation of the cooling medium to the radiator 20, heat exchange is performed between the outside air and the cooling medium. A second circulation channel is a channel that passes the cooling medium through a device 22 that is provided in the branch channel 16*b*, and is configured by the supply channel 14, the return channel 16 and the branch channel 16*b*. The device 22 includes an oil cooler, an EGR cooler, and a heat exchanger such as an ATF (automatic transmission fluid) warmer. During circulation of the cooling medium to the device 22, heat exchange is performed between fluids (for example, oil or EGR gas) that flows in the device 22, and the cooling medium. Further, a third circulation channel is a channel that passes the cooling medium through a heater core 24 as a heat exchanger for an in-vehicle air conditioner that is provided in the branch channel 16*c*, and is configured by the supply channel 14, the return channel 16 and the branch channel 16*c*. During circulation of the cooling medium to the heater core 24, heat exchange is performed between in-vehicle heating air and the cooling medium.

A multifunction valve 18 that is configured as a rotary valve that is used commonly in the first to third circulation channels is provided in a portion where the first to third circulation channels branch, that is, a portion where the return channel 16 branches into the branch channels 16*a* to 16*c*. The multifunction valve 18 includes a valve body having discharge ports 18*a* to 18*c* and an inflow port 18*d*, a rotor that is accommodated in the valve body rotatably around a rotation axis, and a motor that rotates the rotor (none of them is illustrated). During rotation of the rotor by the motor, an opening area between each of the respective discharge ports and the inflow port 18*d* changes, and communication states of the respective discharge ports and the inflow port 18*d* change. That is, the opening areas of the respective branch channels change, and opening degrees of the respective branch channels change. According to the multifunction valve 18, flow rates of the cooling medium that is caused to flow into the respective branch channels, distribution of heat to the heat exchangers of the respective branch channels, and the temperature of the cooling medium that is circulated in the cooling device can be controlled.

The cooling device of the present embodiment further includes an ECU (Electronic Control Unit) 40 as a control device. The ECU 40 includes at least an input/output interface, a memory and a CPU. The input/output interface is provided to take in sensor signals from various sensors, and output operation signals to actuators. The sensors from which the ECU 40 takes in signals include a crank angle sensor 28 for detecting a speed of the engine 10, an accelerator opening degree sensor 30 for detecting an accelerator opening degree, a switch 32 that switches ON/OFF of the heater (an air-conditioner) as in-vehicle air-conditioning. The actuators to which the ECU 40 outputs operation signals include a motor of the aforementioned water pump 12, and the motor of the multifunction valve 18. The memory stores a control program in which an operation plan that will be described later is set, various maps. The CPU reads, e.g., the control program from the memory, and executes the control program, and generates the operation signals based on the sensor signals which are taken in.

Operation of Embodiment

As described above, according to the multifunction valve 18, heat exchange can be performed between the cooling medium and the fluid that flows in the device 22 by passing the cooling medium through the device 22, and therefore, fuel efficiency can be enhanced by cooling the engine oil and the EGR gas. Further, since the cooling medium is passed through the heater core 24 and heat exchange can be performed between the cooling medium and an in-vehicle heating air, in-vehicle air is warmed, or an in-vehicle temperature if a cooler is used can be regulated. From the viewpoint as above, in order to make fuel efficiency and air-conditioning performance compatible, the present inventor is conducting a study on control of the opening and closing states of the respective branch channels based on the operation plan of the rotor which is set by being related to a rotation angle (hereinafter, described as "a rotation angle of the rotor") from a reference position, of the rotor of the multifunction valve 18. An operation plan will be described with reference to FIG. 2.

Figure 2:
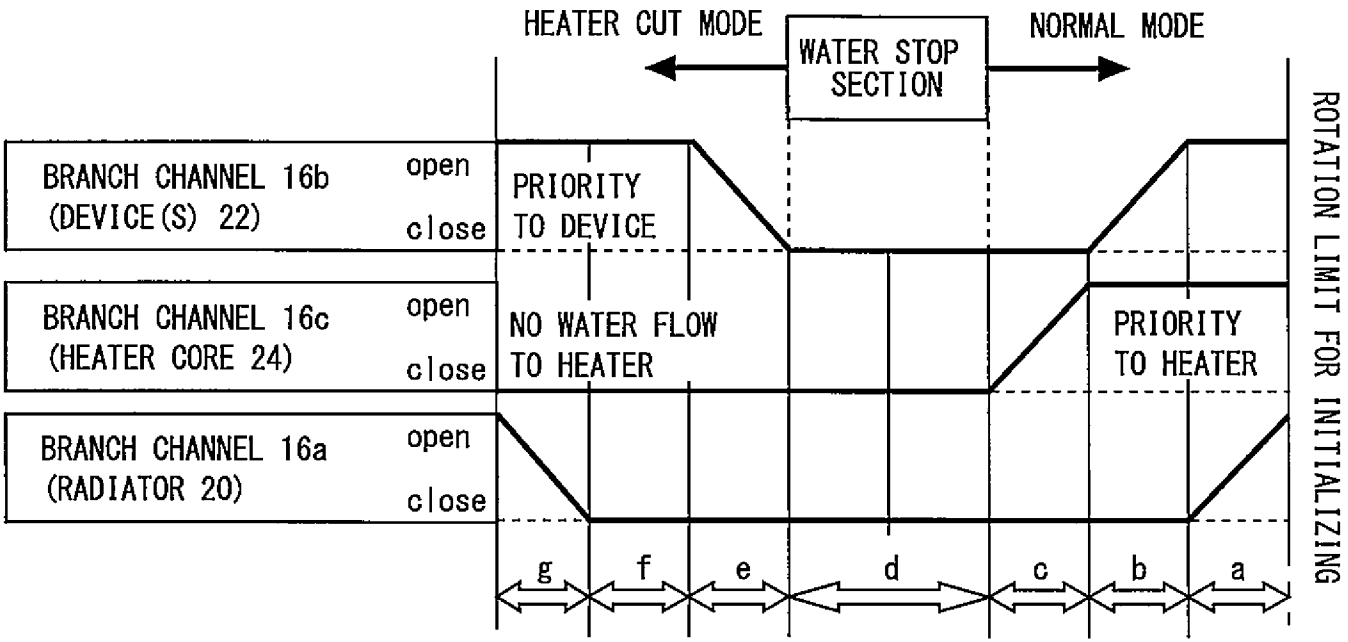
FIG. 2 is a diagram showing an operation plan of a rotor of a multifunction valve.

FIG. 2 is a diagram showing an operation plan of the rotor of the multifunction valve 18. A horizontal axis in FIG. 2 represents a rotation angle of the rotor, whereas a vertical axis represents changes of the opening degrees of the respective branch channels. The operation plan is configured by a normal mode that is used when there is a request (hereinafter, described as "a heater request") to pass the cooling medium through the heater core 24, and a heater cut mode that is used when there is no heater request. The normal mode and the heater cut mode are separated from each other by a region (a region d) where all the branch channels are closed, and the flow rates of the cooling medium caused to flow to all the branch channels become zero. In the following explanation, a section where the rotation angle is in the region d of a rotation range of the rotor (that is, a section where circulation of the cooling medium to the engine 10 is stopped) will be called "a water stop section", and a time period in which the rotation angle of the rotor is in the water stop section will be called "a water stop time period".

In the normal mode, the cooling medium is caused to flow to the heater core 24 with top priority. In FIG. 2, during rotation of the rotor in a direction to advance rightward from the region d, the rotation angle of the rotor moves to a region (a region c) adjacent to the region d. In the region c, the branch channel 16*c* starts to open, and the cooling medium starts to pass through the heater core 24. During further rotation of the rotor from here, the branch channel 16*c* is completely opened, and the rotation angle of the rotor moves to a region (a region b) adjacent to the region c. In the region b, the branch channel 16*b* starts to open, and the cooling medium starts to pass through the device 22. During further rotation of the rotor from here, the branch channel 16*b* is completely opened, and the rotation angle of the rotor moves to a region (a region a) adjacent to the region b. In the region a, the branch channel 16*a* starts to open, and the cooling medium starts to pass through the radiator 20. During further rotation of the rotor from here, the branch channel 16*a* is completely opened. A position of the rotation angle of the rotor at which the branch channel 16*a* is completely opened corresponds to a rotation limit (Rotation limit) of the rotor, and the operation plan is formulated with the rotation limit as the aforementioned reference position.

In the heater cut mode, the cooling medium is not caused to flow to the heater core 24, and the cooling medium is caused to flow to the device 22 with higher priority than to the radiator 20. In FIG. 2, during rotation of the rotor in the direction to advance leftward from the region d, the rotation angle moves to a region (a region e) adjacent to the region d. In the region e, the branch channel 16*b* starts to open, and the cooling medium starts to pass through the device 22. During further rotation of the rotor from here, the branch channel 16*b* is completely opened, and the rotation angle of the rotor moves to a region (a region f) adjacent to the region e. In the region f, only the branch channel 16*b* opens, and the cooling medium passes through only the device 22. During further rotation of the rotor from here, the rotation angle of the rotor moves to a region (a region g) adjacent to the region f. In the region g, the branch channel 16*a* starts to open, and the cooling medium starts to pass through the radiator 20. During further rotation of the rotor from here, the branch channel 16*a* is completely opened.

According to the operation plan shown in FIG. 2, fuel efficiency and air-conditioning performance can be made compatible. In using this operation plan, however, it becomes clear that the following problem arises if mode switching is performed. That is, if the switch 32 is operated to ON by an operator, a heater request is issued, and mode switching is performed to the normal mode from the heater cut mode. For example, if the rotation angle of the rotor is in the region e and a heater request is made, the rotor is rotated and the rotation angle of the rotor is moved to the region c. Further, if the switch 32 is operated to OFF from ON by the operator, the heater request is terminated, and the mode is switched to the heater cut mode from the normal mode. For example, if the rotation angle of the rotor is in the region c and the heater request is terminated, the rotor is rotated, and the rotation angle of the rotor is moved to the region e.

Here, in order to move the rotation angle of the rotor from the region e to the region c, or from the region c to the region e, the rotation angle has to pass through the water stop section. Since movement between the region e and the region c is completed in a short time period, the water stop time period as the rotation angle passes through the region d is also short. However, if the engine load and the engine speed increases and the heat generation amount from the engine 10 increases during the water stop time period, the cooling medium is likely to be boiled by heat received from the engine 10.

Therefore, in the present embodiment, if the rotor is rotated via the water stop section of the region d, in the process of operating the rotor to a predetermined rotation angle, output power restriction control that restricts output power of the engine 10 in a period in which the rotation angle of the rotor is in the water stop section is executed. In more detail, in the cooling device of the present embodiment, if the request (hereinafter, described as "a mode switching request") to switch the normal mode and the heater cut mode is issued, opening degrees of the respective branch channels 16*a* to 16*c* are changed by the rotation operation of the rotor based on the above described operation plan. In a process of the change, the water stop time period in which the rotation angle of the rotor passes through the water stop section of the region d is interposed, and therefore, the output power restriction control which restricts the output power of the engine 10 in the water stop time period is executed. The output power of the engine 10 is a value obtained by multiplying the engine speed by torque, and is correlated with the heat generation amount from the engine 10. Consequently, if the output power restriction control which restricts the output power of the engine 10 is to be performed, the heat generation amount of the engine 10 is restrained, and boiling of the refrigerant can be restrained.

In more detail, in the output power restriction control, the engine speed and the engine load which are calculated based on the detection signals from the crank angle sensor 28 and the accelerator opening degree sensor 30 are monitored, and the engine load and the engine speed are restricted so that the output power of the engine 10 which is calculated from these values does not exceed a predetermined value. As the predetermined value, a value that is set in advance as a threshold value of the output power of the engine 10 that can cause boiling of the cooling medium is used. Further, as the output power restriction of the engine 10, various kinds of control are conceivable, such as restriction of the opening degree of the throttle valve, fuel cut, and retardation such as ignition timing retardation. Control that restricts the opening degree of the throttle value is preferable. This is because the control which restricts the opening degree of the throttle valve gives a smaller sense of incompatibility to the operator than restriction on the output power by fuel cut.

The output power restriction control of the engine 10 described above is effective to restrain boiling of the cooling medium, but is likely to cause a trouble at a time of speed change to a speed reduction side in the engine 10 which includes an automatic transmission (not illustrated). That is to say, if speed change to the speed reduction side of the automatic transmission is performed, and the engine speed is increased, a rotational speed of the water pump 12 increases accordingly. Consequently, if speed change to the speed reduction side of the automatic transmission is performed in the water stop time period in which the rotation angle of the rotor belongs to the region d, insides of the multifunction valve 18 and the water jacket 34 have a fear to have high pressure.

Therefore, in the output power restriction control of the engine 10, speed change to the speed reduction side of the automatic transmission is desirably restricted in addition to the restriction on the engine speed and the engine load described above. Thereby, boiling of the cooling medium is restrained, and increase in the pressure of the multifunction valve 18 and the main body of the engine 10 can be restrained.

Specific Processing in Embodiment

Figure 3:
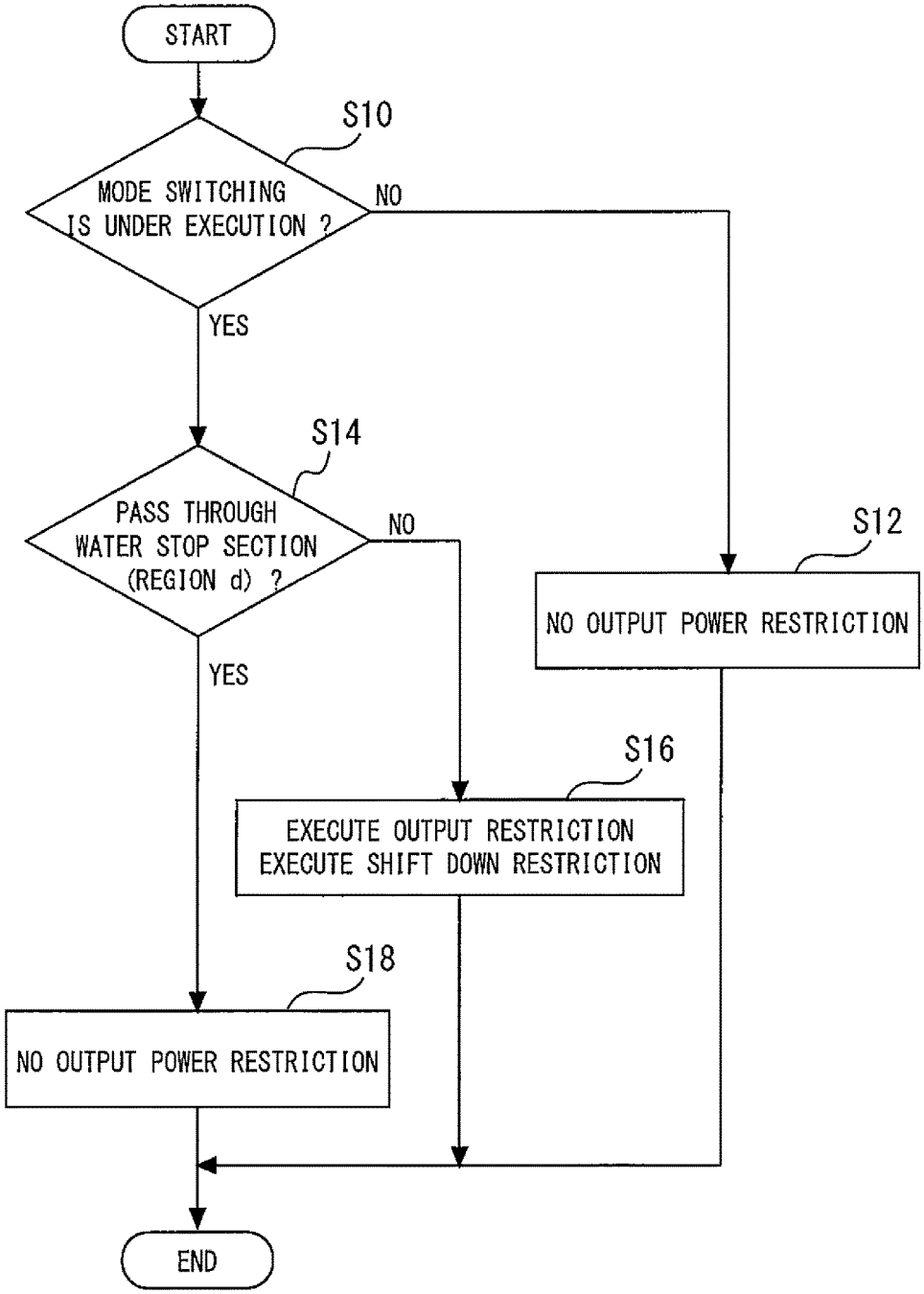
FIG. 3 is a flowchart of a routine that is executed in a cooling device of an embodiment of the present invention.

FIG. 3 is a flowchart of a routine that is executed in a cooling device in the embodiment. The ECU 40 repeatedly executes the routine which is expressed by the flow like this at predetermined control periods corresponding to the number of clock ticks of the ECU.

In the routine shown in FIG. 3, it is firstly determined whether or not mode switching is under execution (step S10). Here, more specifically, it is determined whether or not it belongs to a time period until the rotor reaches the rotation angle to be a target after a mode switch request by a switching operation of the switch 32 is issued. If it is determined that mode switching is not under execution as a result, the flow shifts to the next step, and it is determined that there is no output power restriction of the engine 10 (step S12).

On the other hand, if it is determined that mode switching is under execution in step S10 described above, the flow shifts to the next step, and it is determined whether or not the rotor passes through the water stop section (the region d) (step S14). If it is determined that the rotor does not pass through the water stop section yet as a result, the flow shifts to the next step, and the output power restriction of the engine 10 and shift down restriction are carried out (step S16). Here, more specifically, the opening degree of the throttle valve is restricted so that the output power of the engine 10 does not exceed the predetermined value, and speed change to the speed reducing direction of the automatic transmission is restricted.

On the other hand, if it is determined that the rotor has passed through the water stop section in step S14 described above, the flow shifts to the next step, and the output power restriction of the engine 10 is eliminated (step S18).

As above, according to the processing of the routine shown in FIG. 3, the output power restriction of the engine 10 is executed in the water stop time period in which the rotor is operated in the water stop section during execution of switching of the mode, and therefore, the cooling medium can be avoided from boiling. Further, according to the processing of the routine shown in FIG. 3, in the water stop time period under execution of switching of the mode, shift down restriction of the automatic transmission is carried out, and therefore, the insides of the multifunction valve 18 and the water jacket 34 can be avoided from having high pressure.

Incidentally, in the cooling device in the aforementioned embodiment, the configuration including the mechanical type water pump 12 is described, but an electric water pump in which the impeller is rotationally driven by the rotational force of the motor may be used. If using the electric water pump, the speed of the engine 10 and the rotational speed of the water pump are not interlocked with each other, and therefore, the shift down restriction of the automatic transmission described above does not have to be carried out.

Further, in the cooling device of the aforementioned embodiment, the configuration including the multifunction valve 18 that can regulate flow of the engine cooling water to the radiator 20, the device 22 and the heater core 24 respectively is described. However, embodiments of the present invention are not limited to this configuration of a multifunction valve, and as long as the configuration is such that the rotor passes through the water stop section in the process of operating the rotor in accordance with a request in the multifunction valve in which the operation plan of the rotor includes the water stop section, there is no limitation on the number of ports which are connected to the branch channels and the operation plan of the rotor. Further, the configurations of the radiator 20, the device 22 and the heater core 24 are not limited to the configurations described above, and the configuration in which another heat exchanger that performs heat exchange with the cooling medium which passes through the engine 10 is applied may be adopted.

Figure 4:
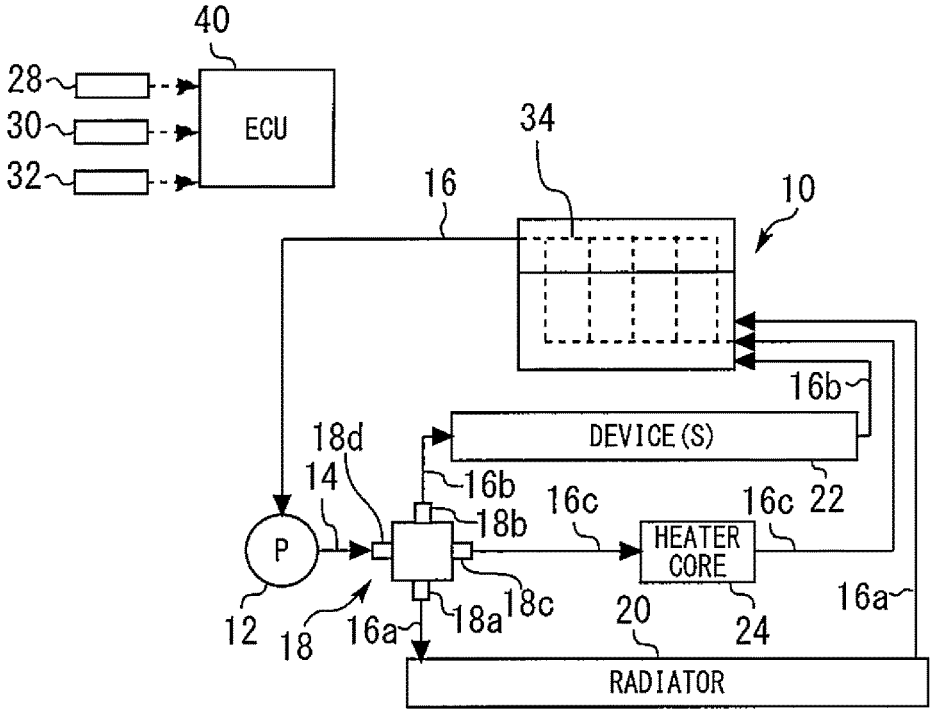
FIG. 4 is a diagram for explaining a modification of a cooling device of an embodiment of the present invention.

Further, in the cooling device of the aforementioned embodiment, the branch channels 16*a* to 16*c* branch off downstream of the return channel 16, and at the branch portion, the multifunction valve 18 is provided. However, embodiments of the present invention are not limited to this configuration of a cooling device, and may also be applied to a configuration of a cooling device shown in FIG. 4 or FIG. 5. FIG. 4 is a diagram for explaining a modification of a cooling device in the embodiment. In the cooling device in FIG. 4, the branch channels 16*a* to 16*c* branch off downstream of the supply channel 14. The branch channels 16*a* to 16*c* are independently connected to the inlet portion of the water jacket 34. Further, the multifunction valve 18 is provided at a portion where the supply channel 14 branches into the branch channels 16*a* to 16*c*. The system like this can also control the opening and closing states of the respective branch channels based on the operation plan shown in FIG. 2.

Figure 5:
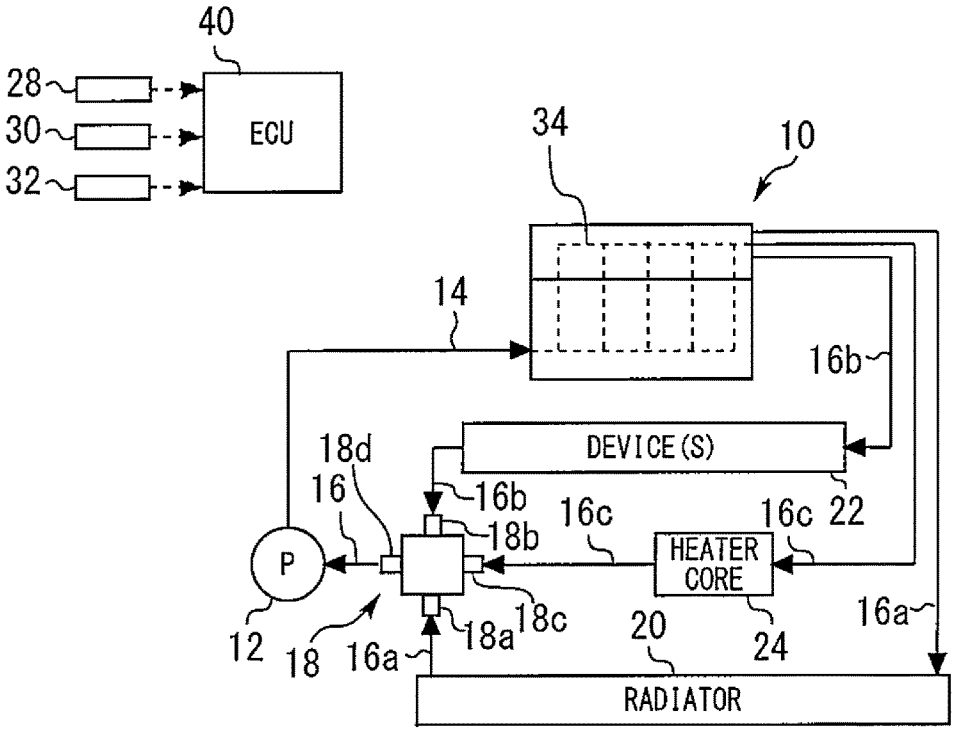
FIG. 5 is a diagram for explaining another modification of a cooling device of an embodiment of the present invention.

Further, FIG. 5 is a diagram for explaining another modification of a cooling device in the embodiment. In the cooling device in FIG. 5, the branch channels 16*a* to 16*c* are independently connected to an outlet portion of the water jacket 34. The branch channels 16*a* to 16*c* merge with the single return channel 16 halfway, and thereafter are connected to the inlet port of the water pump 12. Further, the multifunction valve 18 is provided at a portion where the branch channels 16*a* to 16*c* merge with the return channel 16. That is, in the multifunction valve 18 shown in FIG. 5, the ports 18*a* to 18*c* function as inflow ports, and the port 18*d* functions as a discharge port. The system like this can also control the opening and closing states of the respective branch channels based on the operation plan shown in FIG. 2.

Further, in the cooling device in the aforementioned embodiment, the opening degree of the throttle valve is restricted as output power restriction control, but other known control for restricting the output power of the engine 10, such as fuel cut and retardation of ignition timing may be applied.

Further, in the cooling device of the aforementioned embodiment, the opening degree of the throttle valve is restricted so that the engine output power does not exceed the predetermined value, and speed change to the speed reduction side of the automatic transmission is restricted as the output power restriction control, but speed change restriction to the speed reduction side of the automatic transmission is not essential.

In the cooling device in the aforementioned embodiment, the radiator 20 or the device 22 corresponds to a "first heat exchanger" in the first embodiment of the present invention, and the heater core 24 corresponds to a "second heat exchanger" in the first embodiment of the present invention. The first or the second circulation channel corresponds to a "first cooling medium circuit" of the first embodiment of the present invention. The third circulation channel corresponds to a "second cooling medium circuit" of the first embodiment of the present invention. The multifunction valve 18 corresponds to a "control valve" of the first embodiment of the present invention. The ECU 40 corresponds to a "control device" of the first embodiment of the present invention. Further, in the cooling device in the aforementioned embodiment, the normal mode corresponds to a "first mode" in the second embodiment of the present invention, and the heater cut mode corresponds to a "second mode" in the second embodiment of the present invention.

The invention claimed is:

1. A cooling device for an internal combustion engine, comprising:

a first cooling medium circuit for returning a cooling medium that passes through a main body of the internal combustion engine to the main body after causing the cooling medium to flow through a first heat exchanger;

a second cooling medium circuit for returning the cooling medium that passes through the main body to the main body after causing the cooling medium to flow through a second heat exchanger;

a control valve that is rotatable and commonly used in the first cooling medium circuit and the second cooling medium circuit, and is configured to control changes of opening and closing degrees of the first cooling medium circuit and the second cooling medium circuit respectively in response to a rotation angle of the control valve from a reference angle position, in which a water stop section exists in a rotation range of the control valve due to the structure of the control valve in which no cooling medium flows through the first cooling medium circuit and the second cooling medium circuit in a cooling period of the internal combustion engine during an operation of the control valve; and a control device that is configured to control the operation of the control valve in accordance with a request to the internal combustion engine, and the control device restricts output power of the internal combustion engine to avoided boiling of the cooling medium due to increasing of the heat generation amount of the internal combustion engine, when the control valve rotates through the water stop section during the operation of the control valve.

2. The cooling device for an internal combustion engine according to claim 1, wherein the second heat exchanger includes a heater core of an air-conditioner, the control valve is configured so that a rotation angle corresponding to the water stop section is interposed, if the control valve is operated from a rotation angle corresponding to a first mode in which the second cooling medium circuit is opened, to a rotation angle corresponding to a second mode in which the first cooling medium circuit is opened and the second cooling medium circuit is closed, and the control device is configured to operate the control valve to the rotation angle corresponding to the first mode if a request to cause the cooling medium to flow through the heater core is present, and operate the control valve to the rotation angle corresponding to the second mode if the request to cause the cooling medium to flow through the heater core is absent.

3. The cooling device for an internal combustion engine according to claim 1, wherein the control device is configured to control an engine speed and an engine load of the internal combustion engine so that the output power of the internal combustion engine in the period in which the rotation angle of the control valve is in the water stop section does not exceed a predetermined value.

* * * * *